US010160574B2

(12) United States Patent
Juan

(10) Patent No.: US 10,160,574 B2
(45) Date of Patent: Dec. 25, 2018

(54) CARRY-ON PACKAGE BAG

(71) Applicant: Tze-Yin Juan, Taipei (TW)

(72) Inventor: Kuang-Wen Juan, Taipei (TW)

(73) Assignee: Daniel Derhsu Chang, Taipei (TW)

( * ) Notice: Subject to any disclaimer, the term of this patent is extended or adjusted under 35 U.S.C. 154(b) by 8 days.

(21) Appl. No.: 15/474,159

(22) Filed: Mar. 30, 2017

(65) Prior Publication Data

US 2017/0291741 A1 Oct. 12, 2017

(30) Foreign Application Priority Data

Apr. 8, 2016 (TW) ..... 105204897 U

(51) Int. Cl.

| | |
|---|---|
| ***B65D 33/24*** | (2006.01) |
| ***B65D 30/18*** | (2006.01) |
| ***B65D 30/20*** | (2006.01) |
| ***B65D 33/08*** | (2006.01) |
| ***B65D 33/14*** | (2006.01) |

(52) U.S. Cl.

CPC ..... *B65D 33/243* (2013.01); *B65D 31/08* (2013.01); *B65D 31/10* (2013.01); *B65D 33/08* (2013.01); *B65D 33/14* (2013.01)

(58) Field of Classification Search

CPC ..... B65D 33/243; B65D 33/08; B65D 33/14; B65D 31/08; B65D 31/10

USPC ... 383/10, 15, 77, 85, 86.1, 86.2, 88, 89, 92

See application file for complete search history.

(56) References Cited

U.S. PATENT DOCUMENTS

| | | | | |
|---|---|---|---|---|
| 1,190,492 A * | 7/1916 | Way, Jr. | B65D 33/08 | 383/10 |
| 1,953,689 A * | 4/1934 | Ottinger | B65D 33/243 | 229/84 |
| 1,973,236 A * | 9/1934 | Vierengel | B65D 33/243 | 229/84 |
| 2,463,302 A * | 3/1949 | Orchard | B65D 33/243 | 229/68.2 |
| 3,442,437 A * | 5/1969 | Mann | B65D 33/02 | 383/10 |
| 3,447,737 A * | 6/1969 | Mahr | B65D 33/243 | 383/10 |
| 4,610,029 A * | 9/1986 | Huhtala | B65D 33/08 | 383/10 |
| 5,114,243 A * | 5/1992 | Thier | B65D 33/24 | 383/85 |

* cited by examiner

*Primary Examiner* — Jes F Pascua

(74) *Attorney, Agent, or Firm* — Rosenberg, Klein & Lee

(57) ABSTRACT

A carry-on package bag includes a bag opening and two primary bag sheets opposite to each other. Top edges of the primary bag sheets collectively define the bag opening. Each primary bag sheet includes a first fold line, a first foldable sealing section below the first fold line, and a second foldable sealing section between the first fold line and the top edge. Each first foldable sealing section has at least one first carrying hole. Each second foldable sealing section has at least one second carrying hole symmetric with respect to the first carrying hole about the first fold line. The second foldable sealing sections are foldable along the first fold lines toward the same direction to be overlapping and stacked on the first foldable sealing sections so that the second carrying hole and the first carrying hole correspond to and communicate with each other.

24 Claims, 8 Drawing Sheets

CARRY-ON PACKAGE BAG

FIELD OF THE INVENTION

The present invention relates to a carry-on package bag, and in particular to a carry-on package bag having carrying holes.

BACKGROUND OF THE INVENTION

For easy carrying by users, common carry-on package bags, such as paper bags that are often considered more environmentally friendly, are often manufactured so as to provide carrying handles mounted on a bag body, or form an opening, through cutting the bag at a location close to an opening of the bag, to receive fingers to extend therethrough. However, adding carrying handles to the bag requires handling with a large amount of human labor and is not suitable for automatized manufacturing, so that the amount of human labor and time cost consumed are great. Cutting the bag to form a through opening, although being a process that can be carried out by machines, often causes stress concentration in the bag at a location close to the through opening so that the bag is susceptible to deformation and breaking when loaded with heavy articles, thus making the bag not durable. Thus, these two ways of manufacturing both need further improvement concerning cost, durability, and convenience of use.

SUMMARY OF THE INVENTION

Thus, an objective of the present invention is to provide a carry-on package bag that allows for fully automatized production, is easy to carry, and is of improved durability.

A carry-on package bag according to the present invention comprises a bag opening and two primary bag sheets, wherein the primary bag sheets are opposite to each other and have top edges that collectively define a bag opening, each of the primary bag sheets comprising a first fold line, a first foldable sealing section located below the first fold line, and a second foldable sealing section located between the first fold line and the top edge, each of the first foldable sealing sections being formed with at least one first carrying hole, each of the second foldable sealing sections being formed with at least one second carrying hole that is arranged symmetric with respect to the first carrying hole about the first fold line, the second foldable sealing sections of the primary bag sheets being foldable along the first fold lines toward the same direction to be overlapping and stacked on the first foldable sealing sections so that the second carrying hole and the first carrying hole correspond to and communicate with each other.

In some embodiments, each of the first foldable sealing sections is further formed with two extend-through retention slits respectively located at left and right sides of the first carrying hole, and each of the second foldable sealing sections is further formed with two extend-through retention tabs respectively located at left and right sides of the second carrying hole so that when the second foldable sealing sections of the primary bag sheets are folded along the first fold lines toward the same direction to be overlapping and stacked on the first foldable sealing sections, the extend-through retention tabs are set at locations each corresponding to one of the extend-through retention slits of each of the first foldable sealing sections and the extend-through retention tabs are each allowed to extend through one of the extend-through retention slits to have the first foldable sealing sections and the second foldable sealing sections securely attached to each other.

In some embodiments, each of the extend-through retention slits comprises a first slit section extending leftwards and rightwards to receive one of the extend-through retention tabs corresponding thereto to extend therethrough, a second slit section extending downward from a middle point between two opposite ends of the first slit section, and a third slit section extending leftwards and rightwards from an end of the second slit section that is distant from the first slit section.

In some embodiments, each of the extend-through retention slits further comprises two four slit sections extending upward from the two opposite ends of the first slit section respectively.

In some embodiments, each of the first foldable sealing sections is further formed with a first hanging hole and each of the second foldable sealing sections is further formed with a second hanging hole, so that when the primary bag sheets are folded along the first fold lines toward the same direction to be overlapping and stacked on the second foldable sealing sections, the first hanging hole and the second hanging hole correspond to and communicate with each other.

In some embodiments, each of the first foldable sealing sections is formed with three first carrying holes and each of the second foldable sealing sections is formed with three second carrying holes.

In some embodiments, the first carrying holes of each of the first foldable sealing section are spaced from each other leftward and rightward and a middle one of the first carrying holes is located further from a top edge of the primary bag sheet than left and right ones of the first carrying holes.

In some embodiments, the carry-on package bag further comprises a bottom sheet connected to bottom edges of the primary bag sheets and two side bag sheets extending upward from two opposite side edges of the bottom sheet, respectively, and are each connected to side edges of the primary bag.

In some embodiments, each of the side bag sheets is formed with a vertical fold line, at least an extend-through retention slit, and at least an extend-through retention tab, each of the side bag sheets comprising a first foldable section located at one side of the vertical fold line and a second foldable section located at an opposite side of the vertical fold line, each of the side bag sheets being foldable along the vertical fold line such that the first foldable section and the second foldable section of the side bag sheet are overlapping and stacked on each other and the extend-through retention slit and the extend-through retention tab of the side bag sheet respectively corresponding to the extend-through retention slits and the extend-through retention tabs of the primary bag sheets.

In some embodiments, each of the side bag sheets is further formed with at least a side carrying hole, so that when the side bag sheets re folded along the vertical fold lines, the side carrying holes of the side bag sheets respectively correspond to the first carrying holes and the second carrying holes of the primary bag sheets.

In some embodiments, each of the primary bag sheets further comprises a second fold line that is located closer to the top edge of the primary bag sheet than the first fold line and a third foldable sealing section extending upward from the second fold line and located closer to the top edge of the primary bag sheet than the second foldable sealing section, the third foldable sealing section being formed with at least one third carrying hole, the third foldable sealing sections of the primary bag sheets being foldable along the second fold lines toward the same direction so as to be overlapping and stacked on the second foldable sealing sections to allow the third carrying hole to correspond to and communicate with the first carrying holes and the second carrying holes.

In some embodiments, each of the first foldable sealing sections is formed with two extend-through retention slits respectively located at left and right sides of the first carrying hole; each of the second foldable sealing sections is formed with two extend-through retention tabs respectively located at left and right sides of the second carrying hole; and each of the third foldable sealing sections being formed with two extend-through retention tabs respectively located at left and right sides of the third carrying holes so that when the primary bag sheets are folded along the first fold lines and the second fold lines toward the same direction, the extend-through retention tabs of the third foldable sealing sections and the extend-through retention tabs of the second foldable sealing sections correspond to each other to allow the extend-through retention tabs to each extend one of the extend-through retention slits of each of the first foldable sealing sections to have the first foldable sealing sections, the second foldable sealing sections, and the third foldable sealing sections securely attached to each other.

In some embodiments, each of the third foldable sealing sections is further formed with a third hanging hole, so that when the primary bag sheets are folded along the first fold lines and the second fold lines toward the same direction to have the first foldable sealing sections, the second foldable sealing sections, and the third foldable sealing sections overlapping and stacked on each other, the first hanging holes, the second hanging holes, and the third hanging holes correspond to and communicate with each other.

In some embodiments, each of the third foldable sealing sections is formed with three third carrying holes.

In some embodiments, each of the second foldable sealing sections further comprises a tongue plate connected to a bottom edge of the second carrying hole so that when the second foldable sealing sections of the primary bag sheets are folded along the first fold lines toward the same direction to be overlapping and stacked on the first foldable sealing sections, the tongue plate extends from the second foldable sealing section through the first carrying hole of the first foldable sealing section The efficacy of the present invention is that the primary bag sheets are foldable such that the first carrying holes and the second carrying holes may communicate with each other to allow easy carrying and lifting of the package bag. Further, the stacked arrangement of the first foldable sealing sections and the second foldable sealing sections helps distribute weight carried thereby improving durability of the carry-on package bag.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
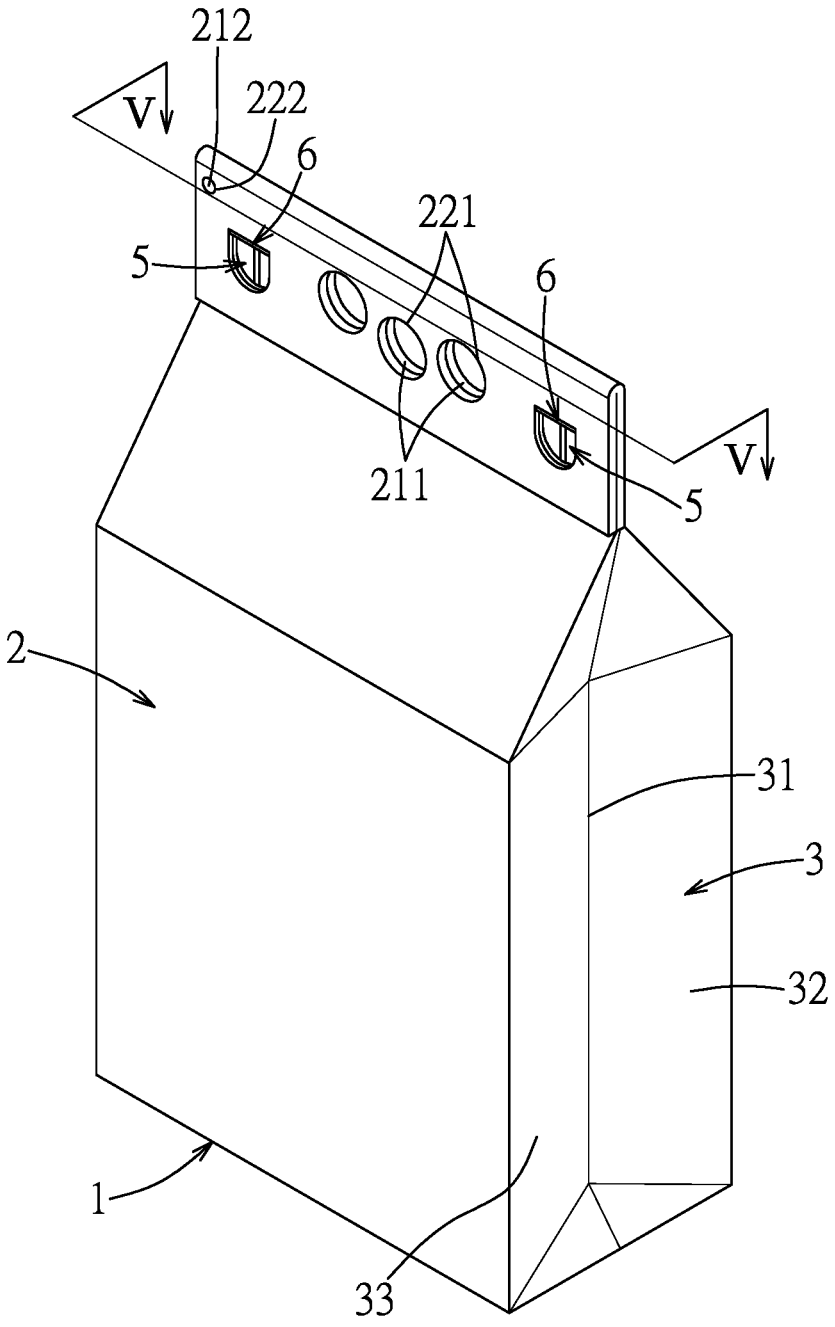
FIG. 1 is a perspective view showing a carry-on package bag according to a first embodiment of the present invention.

Before a detailed description of the present invention is provided, it is noted that in the following description, similar components/parts are designated with the same reference numerals.

Figure 2:
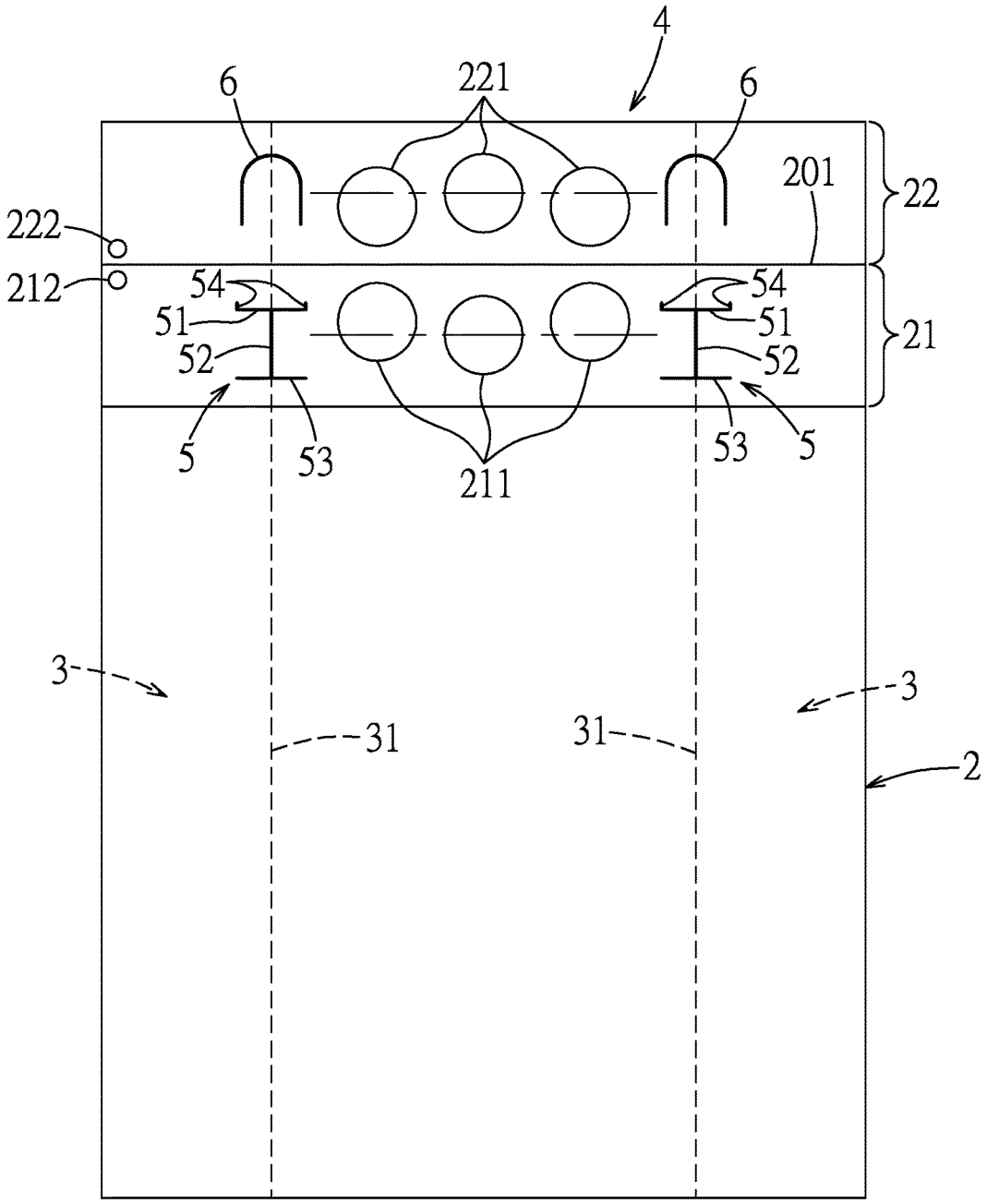
FIG. 2 is a planar view of a primary bag sheet of the first embodiment in a developed form.
Figure 3:
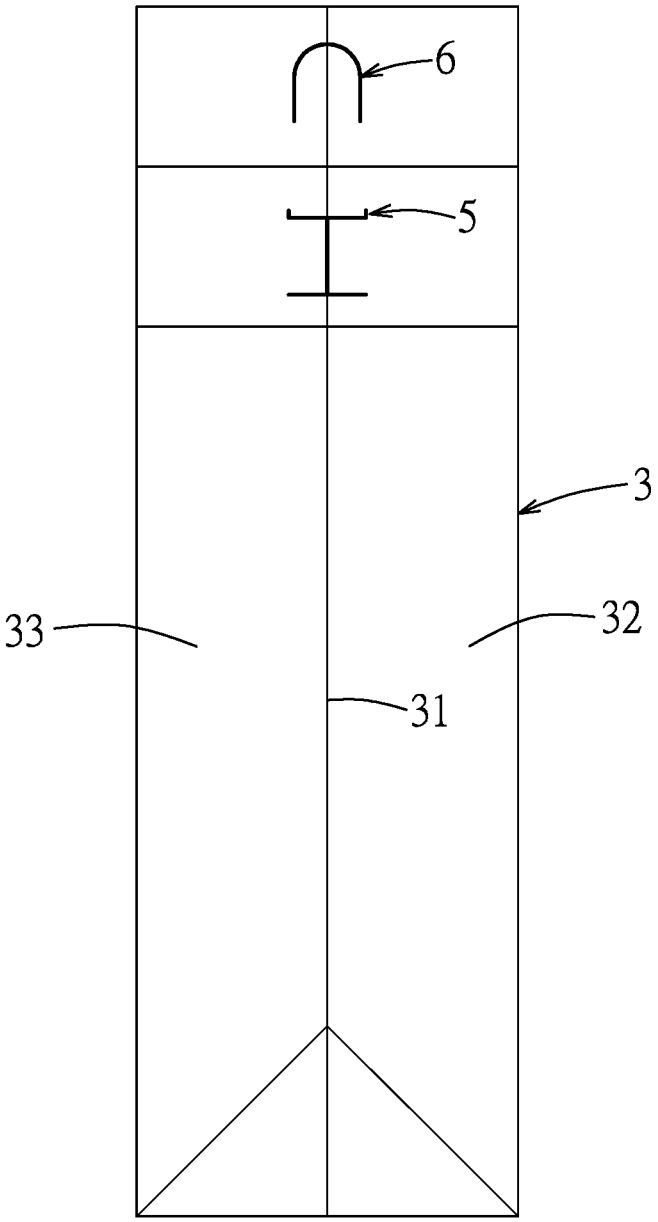
FIG. 3 is a planar view of a side bag sheet of the first embodiment in a developed form.

Referring to FIGS. 1-3, the present invention provides a carry-on package bag of which a first embodiment comprises a bottom sheet 1, two primary bag sheets 2, two side bag sheets 3, and a bag opening 4. The primary bag sheets 2 extend upwards from two opposite side edges of the bottom sheet 1, respectively and the primary bag sheets 2 are opposite to each. The side bag sheets 3 extend upward from the other two opposite side edges of the bottom sheet 1, respectively, and are each connected to side edges of the primary bag sheets 2. The bag opening 4 is defined collectively by the primary bag sheets 2 and the side bag sheets 3.

In the first embodiment, each of the primary bag sheets 2 comprises a first fold line 201, a first foldable sealing section 21 located below the first fold line 201, and a second foldable sealing section 22 located between the first fold line 201 and a top edge of the primary bag sheet 2. The second foldable sealing sections 22 of the primary bag sheets 2 are foldable, along the first fold lines 201, toward the same direction to be stacked on the first foldable sealing sections 21.

In the first embodiment, each of the first foldable sealing sections 21 is formed with three first carrying holes 211, two extend-through retention slits 5 respectively located at two opposite, left and right, sides of the first carrying holes 21, and a first hanging hole 212. The first carrying holes 211 are arranged spaced from each other horizontally in leftward/rightward directions and a middle one of the first carrying holes 211 is further away from the top edge of the primary bag sheet 2 than a left one and a right one of the first carrying holes 211. In other words, the middle first carrying hole 211 is located slightly lower than the left and right first carrying holes 211 to facilitate gripping or carrying by a user. Each of the extend-through retention slits 5 comprises a first slit section 51 extending horizontally in the leftward/rightward directions, a second slit section 52 extending vertically downward from a middle point between two opposite ends of the first slit section 51, a third slit section 53 extending horizontally in the leftward and rightward directions from an end of the second slit section 52 that is distant from the first slit section 51, and two fourth slit sections 54 extending vertically upward from two opposite ends of the first slit section 51, respectively.

Each of the second foldable sealing sections 22 is formed with three second carrying holes 221 that are symmetric with respect to the first carrying holes 211 about the first fold line 201, two extend-through retention tabs 6 respectively located at two opposite, left and right, sides of the second carrying holes 221 and extending in a direction toward the bag opening 4, and a second hanging hole 222.

Figure 4:
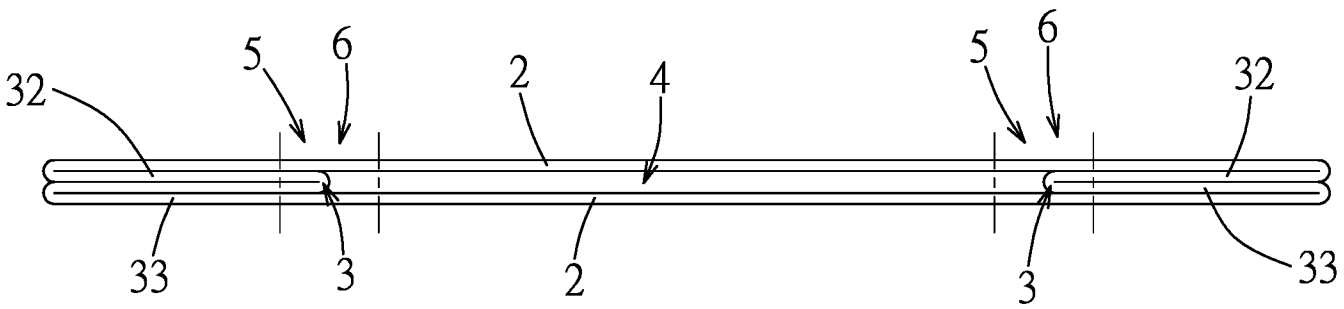
FIG. 4 is a top view of the first embodiment, illustrating two side bag sheets of the first embodiment are set, in a folded form, between two primary bag sheets.
Figure 5:
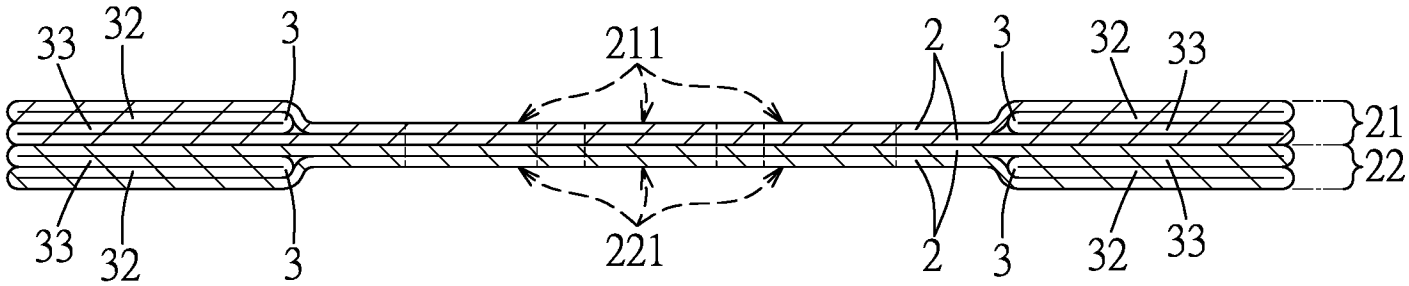
FIG. 5 is a cross-sectional view, illustrating a first foldable sealing section and a second foldable sealing section of the first embodiment are stacked on each other.

Referring additionally to FIGS. 4 and 5, when the second foldable sealing sections 22 are folded along the first fold lines 201 toward the same direction to be stacked on the first foldable sealing sections 21, the second carrying holes 221 are set to correspond to and communicate with the first carrying holes 211, respectively, and the extend-through retention tabs 6 are each set at a location corresponding to one of the extend-through retention slits 5 of each of the first foldable sealing sections 21 to allow the extend-through retention tabs 6 to each penetrate through one of the extend-through retention slits 5, so as to have the first foldable sealing section 21 and the second foldable sealing section 22 attached to each other. Further, the first hanging holes 212 are also set in communication with the second hanging holes 222. Specifically, if a distance between the first slit section 51 and the third slit section 53 of the extend-through retention slit 5 is less than a length of the extend-through retention tab 6, then the extend-through retention tab may first extend through the first slit section 51 and then extend through the third slit section 53, and this, as compared to a configuration where the extend-through retention tab 6 extends through only the first slit section 51, may strengthen mutual attachment of the first foldable sealing section 21 and the second foldable sealing section 22 to each other.

In the first embodiment, the first carrying holes 211 and the second carrying holes 221 are provided for carrying or lifting by a user and the number of each of them is three. However, in other embodiments that are functionally equivalent, the number, the shape, and the way of arrangement of the first carrying holes 211 and the second carrying holes 221 can be different and are not limited to what described in this embodiment. For example, an example of a configuration including just one horizontal thin and elongate first carrying hole 211 and one corresponding second carrying hole 221 is also feasible. In addition, the first hanging hole 212 and the second hanging hole 222 are arranged to provide a function of hanging the carry-on package bag and it is apparent that a configuration including no first hanging hole 212 and second hanging hole 222, or one that including different numbers of the first hanging hole 212 and the second hanging hole 222, are both feasible.

In the first embodiment, each of the side bag sheets 3 is formed with a vertical fold line 31, an extend-through retention slit 5, and an extend-through retention tab 6. Each of the side bag sheets 3 comprises a first foldable section 32 located at one side of the vertical fold line 31 and a second foldable section 33 located on an opposite side of the vertical fold line 31. Each of the side bag sheets 3 is foldable along the vertical fold line 31 such that the first foldable section 32 and the second foldable section 33 of the side bag sheet 3 overlap each other. And, the extend-through retention slit 5 and the extend-through retention tab 6 of each of the side bag sheets 3 correspond, respectively, to the extend-through retention slits 5 and the extend-through retention tabs 6 of the primary bag sheets 2. More specifically speaking, when the side bag sheets 3 are folded along the vertical fold lines 31 respectively, the carry-on package bag is set in a flattened stowable condition and under this condition, the side bag sheets 3 are received, in a folded condition, between the primary bag sheets 2 (as shown in FIG. 4). For the first embodiment, when the carry-on package bag is set in the stowable condition, the side bag sheets 3 are interposed between the extend-through retention tabs 6 and between the extend-through retention slits 5 of the primary bag sheets 2, and thus, each of the side bag sheets 3 must be provided with an extend-through retention slit 5 and an extend-through retention tab 6 corresponding to the structure of the primary bag sheets 2 so that when the carry-on package bag is in the stowable condition, the extend-through retention slit 5 and the extend-through retention tab 6 of each of the side bag sheets 3 provide the same function as, and in collaborative combination with, the extend-through retention slits 5 and the extend-through retention tabs 6 of the primary bag sheets 2. In other equivalent embodiments, based on the difference of the width of the side bag sheets 3 or the difference of the locations of the first carrying holes 211 and the second carrying holes 221, each of the side bag sheets 3 may be additionally provided with side carrying holes or a side hanging hole (not shown) corresponding to the first carrying holes 211 and the second carrying holes 221 so that when the carry-on package bag is in the stowable condition, the side carrying holes correspond to the first carrying holes 211 and the second carrying holes 221 of the primary bag sheets 2 and the side hanging hole corresponds to the first hanging hole 212 and the second hanging hole 222 of the primary bag sheets 2.

In the first embodiment, the carry-on package bag is made of paper; however, the material that can be used to make the carry-on package bag of the present invention is not limited to what described with reference to the first embodiment and may alternatively be plastics, nonwoven fabrics, or other materials that are commonly used for packaging purposes.

Figure 6:
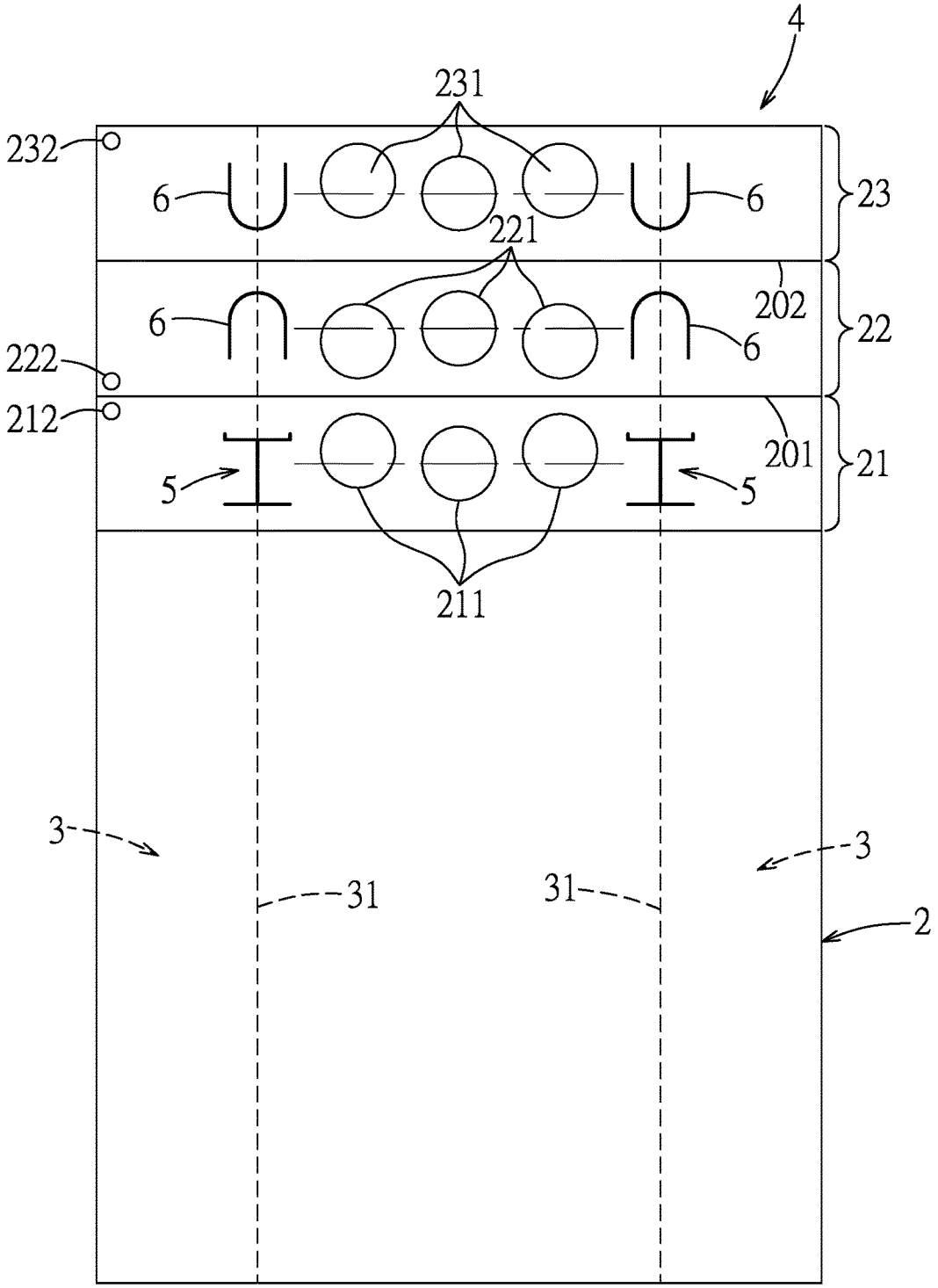
FIG. 6 is a planar view illustrating a primary bag sheet of a carry-on package bag according to a second embodiment of the present invention.
Figure 7:
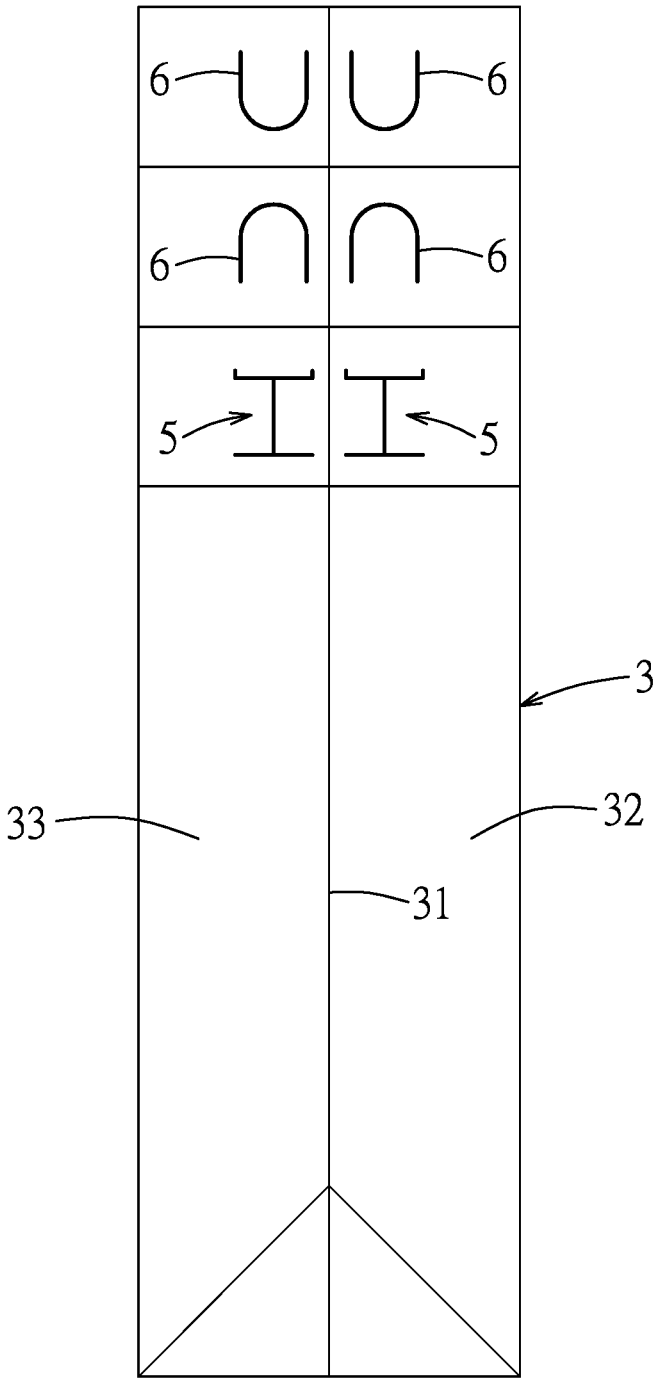
FIG. 7 is a planar view of a side bag sheet of the second embodiment in a developed form.

As shown in FIGS. 6 and 7, a second embodiment of the carry-on package bag according to the present invention is shown. The second embodiment is different from the first embodiment in that in the second embodiment, each of the primary bag sheets 2 further comprises a second fold line 202 that is closer to the top edge of the primary bag sheet 2 than the first fold line 201 and a third foldable sealing section 23 extending upward from the second fold line 202 and located closer to the top edge of the primary bag sheet 2 than the second foldable sealing section 22.

In the second embodiment, the third foldable sealing section 23 is formed with three third carrying holes 231, two extend-through retention tabs 6 respectively located on two opposite, left and right, sides of the third carrying holes 231 and extending in a direction away from the bag opening 4, and a third hanging hole 232. The third foldable sealing sections 23 of the primary bag sheets 2 are foldable along the second fold lines 202 toward the same direction so as to overlap and stack on the second foldable sealing sections 22. More specifically speaking, the primary bag sheets 2 are first folded along the second fold lines 202 and then folded along the first fold lines 201 to have the first foldable sealing sections 21, the second foldable sealing sections 22, and the third foldable sealing section 23 all overlapping and stacked on each other. Under this condition, the first carrying holes 211, the second carrying holes 221, and the third carrying holes 231 correspond to and communicate with each other and the third hanging hole 232 corresponds to and communicate with the first hanging hole 212 and the second hanging hole 222; and the extend-through retention tabs 6 of the third foldable sealing sections 23 correspond to and overlap the extend-through retention tabs 6 of the second foldable sealing sections 22 so that the extend-through retention tabs 6 may collectively extend through one of the extend-through retention slits 5 of each of the first foldable sealing sections 21 to allow the first foldable sealing sections 21, the second foldable sealing sections 22, and the third foldable sealing sections 23 attached to each other.

Further, in the second embodiment, each of the side bag sheets 3 is formed with fourth extend-through retention tabs 6 and two extend-through retention slits 5. Similar to the first embodiment, in the stowable condition of the carry-on package bag, the extend-through retention tabs 6 and the extend-through retention slits 5 of the side bag sheets 3 correspond to the extend-through retention tabs 6 and the extend-through retention slits 5 of the primary bag sheets 2.

Figure 8:
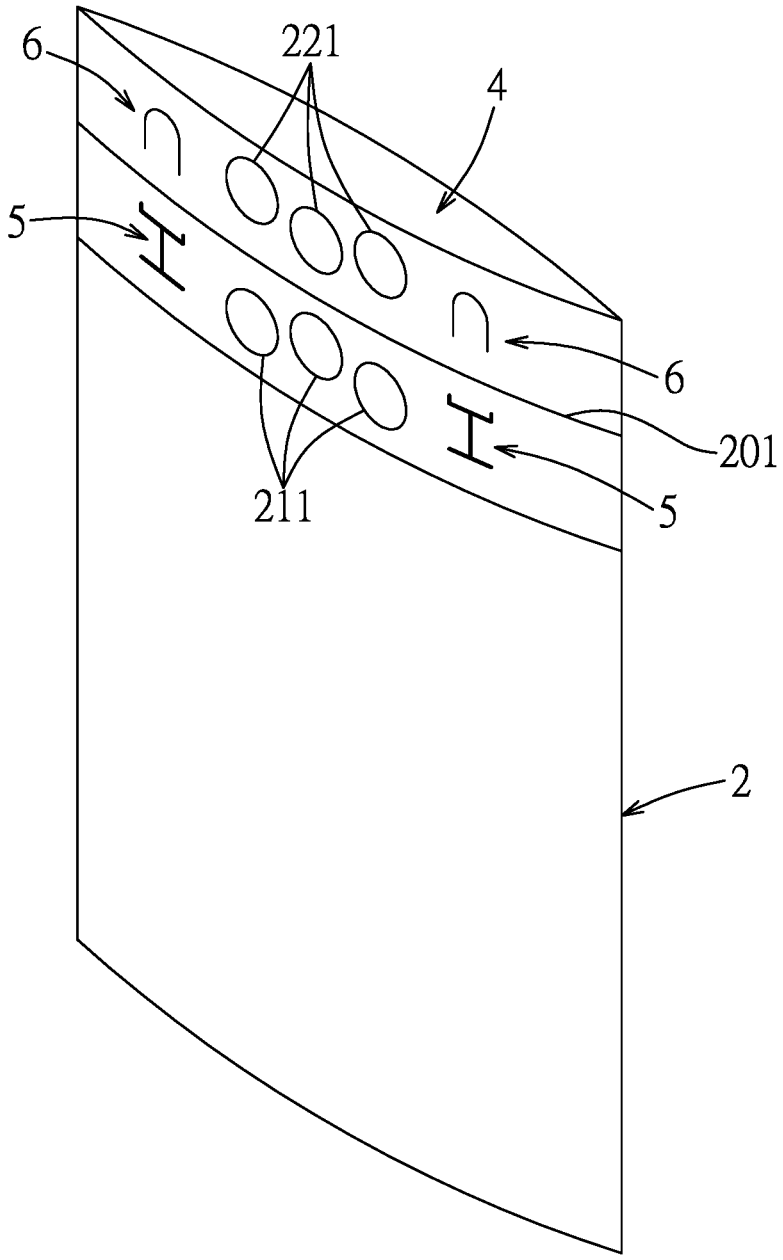
FIG. 8 is a perspective view showing a carry-on package bag according to a third embodiment of the present invention.

As shown in FIG. 8, a third embodiment of the carry-on package bag according to the present invention is provided. The third embodiment is different from the first embodiment in that in the third embodiment, the carry-on package bag is formed of just two primary bag sheets 2. In other words, in the third embodiment, the carry-on package bag does not comprise the bottom sheet 1 and the side bag sheets 3 (as those shown in FIG. 1), and is formed by having bottom edges and side edges of the primary bag sheets 2 connected to thereby show a configuration of an envelope.

Figure 9:
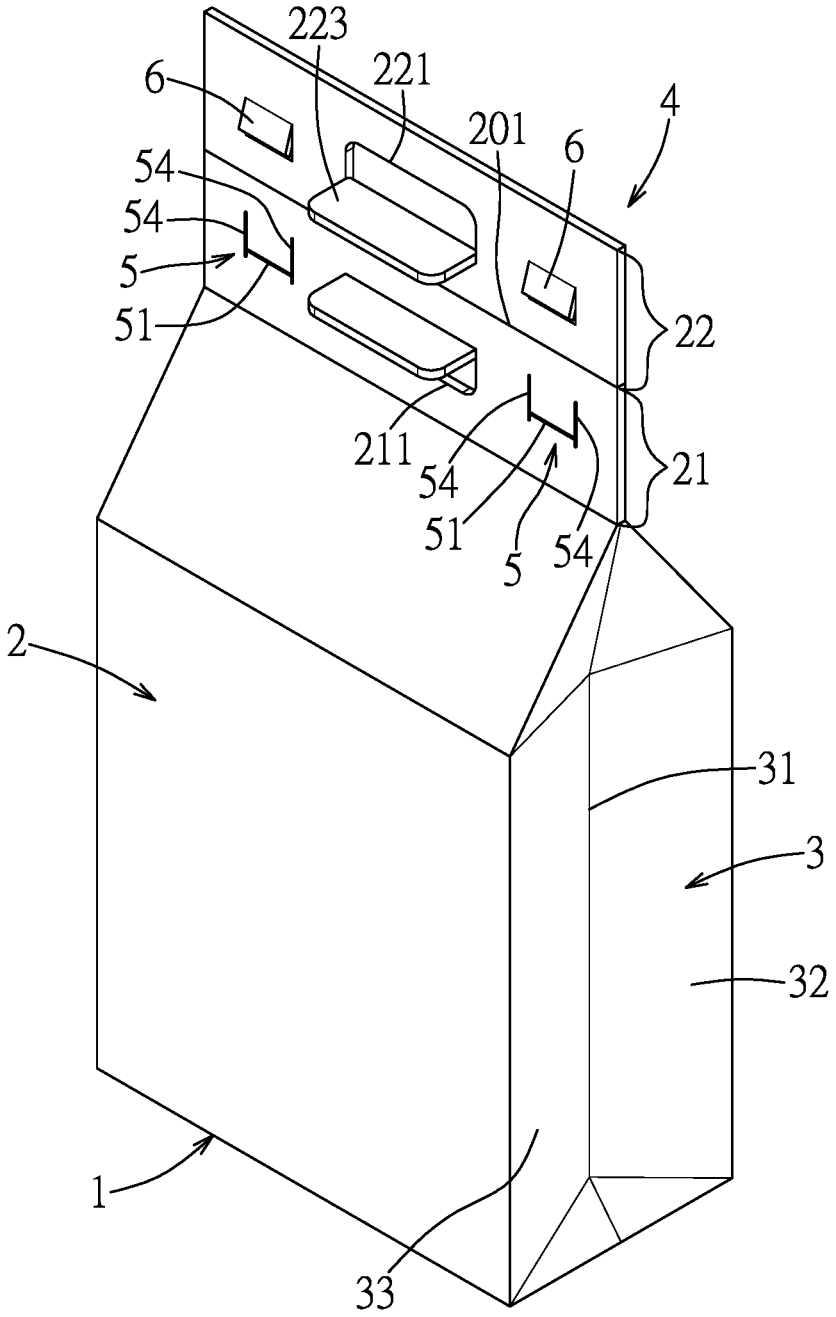
FIG. 9 is a perspective view showing a carry-on package bag according to a fourth embodiment of the present invention.

As shown in FIG. 9, a fourth embodiment of the carry-on package bag according to the present invention is provided. The fourth embodiment is different from the first embodiment in that in the fourth embodiment, the first foldable sealing section 21 is only formed with one first carrying hole 211, and the second foldable sealing section 22 is also formed with just one second carrying hole 221. The second foldable sealing section 22 further comprises a tongue plate 223 connected to a bottom edge of the second carrying hole 221 so that when the second foldable sealing sections 22 of the primary bag sheets 2 are folded along the first fold lines 201 toward the same direction and are thus overlapping and stacked on the first foldable sealing sections 21, the tongue plates 223 are allowed to extend from the second foldable sealing sections 22 toward and through the first carrying holes 211 of the first foldable sealing sections 21. In addition, in the fourth embodiment, the extend-through retention tabs 6 are arranged to extend in a direction away from the bag opening 4, and each of the extend-through retention slits 5 comprises just one first slit section 51 and two fourth slit sections 54, so that when the second foldable sealing sections 22 are folded along the first fold lines 201 to overlap and stack on the first foldable sealing sections 21, the extend-through retention tabs 6 extend, in a direction from the lower side to the upper side, through the first slit sections 51 of the extend-through retention slits 5 to achieve a similar effect of attaching the first foldable sealing sections 21 and the second foldable sealing sections 22 to each other. Further, in other equivalent embodiments, the direction and shape of the extend-through retention slits 5 and the direction of the extend-through retention tabs 6 are not limited to what described with reference to the instant embodiment. For example, when the first foldable sealing sections 21 and the second foldable sealing sections 22 are stacked on each other, various configurations where the extend-through retention tabs 6 extend through the extend-through retention slits 5 in a direction from the upper side toward the lower side or from the left side toward the right side, or from the right side toward the left side, are all feasible.

In summary, the carry-on package bag according to the present invention is configured to allow the primary bag sheets 2 to be folded such that the first carrying holes 211 and the second carrying holes 221 correspond to and communicate with each other to allow for easy carrying and lifting and a multilayer structure formed through such a stacked arrangement (see FIG. 5) helps distribute the weight carried by the carry-on package bag so that improvement in respect of structural strength and durability over the prior art carry-on package bag can be achieved. The arrangement of the carrying holes makes the use of the carry-on package bag easy and also allows for automatized production without additional human labor involved.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A carry-on package bag, comprising:

a bag opening; and two primary bag sheets, which are opposite to each other and have top edges that collectively define a bag opening, each of the primary bag sheets comprising a first fold line, a first foldable sealing section located below the first fold line, and a second foldable sealing section located between the first fold line and the top edge, each of the first foldable sealing sections being formed with at least one first carrying hole, each of the second foldable sealing sections being formed with at least one second carrying hole that is arranged symmetric with respect to the first carrying hole about the first fold line, the second foldable sealing sections of the primary bag sheets being foldable along the first fold lines toward the same direction to be overlapping and stacked on the first foldable sealing sections so that the second carrying hole and the first carrying hole correspond to and communicate with each other;

each of the first foldable sealing sections being further formed with two extend-through retention slits respectively located at left and right sides of the first carrying hole, and each of the second foldable sealing sections being further formed with two extend-through retention tabs respectively located at left and right sides of the second carrying hole so that when the second foldable sealing sections of the primary bag sheets are folded along the first fold lines toward the same direction to be overlapping and stacked on the first foldable sealing sections, the extend-through retention tabs are set at locations each corresponding to one of the extend-through retention slits of each of the first foldable sealing sections and the extend-through retention tabs are each allowed to extend through one of the extend-through retention slits to have the first foldable sealing sections and the second foldable sealing sections securely attached to each other.

2. The carry-on package bag as claimed in claim 1, wherein each of the extend-through retention slits comprises a first slit section extending leftwards and rightwards to receive one of the extend-through retention tabs corresponding thereto to extend there through, a second slit section extending downward from a middle point between two opposite ends of the first slit section, and a third slit section extending leftwards and rightwards from an end of the second slit section that is distant from the first slit section.

3. The carry-on package bag as claimed in claim 2, wherein each of the extend-through retention slits further comprises two four slit sections extending upward from the two opposite ends of the first slit section respectively.

4. The carry-on package bag as claimed in claim 3, wherein each of the first foldable sealing sections is further formed with a first hanging hole and each of the second foldable sealing sections is further formed with a second hanging hole, so that when the primary bag sheets are folded along the first fold lines toward the same direction to be overlapping and stacked on the second foldable sealing sections, the first hanging hole and the second hanging hole correspond to and communicate with each other.

5. The carry-on package bag as claimed in claim 4, wherein each of the first foldable sealing sections is formed with three first carrying holes and each of the second foldable sealing sections is formed with three second carrying holes.

6. The carry-on package bag as claimed in claim 5, wherein the first carrying holes of each of the first foldable sealing section are spaced from each other leftward and rightward and a middle one of the first carrying holes is located further from a top edge of the primary bag sheet than left and right ones of the first carrying holes.

7. The carry-on package bag as claimed in claim 1, wherein each of the second foldable sealing sections further comprises a tongue plate connected to a bottom edge of the second carrying hole so that when the second foldable sealing sections of the primary bag sheets are folded along the first fold lines toward the same direction to be overlapping and stacked on the first foldable sealing sections, the tongue plate extends from the second foldable sealing section through the first carrying hole of the first foldable sealing section.

8. A carry-on package bag, comprising:

a bag opening;

two primary bag sheets, which are opposite to each other and have top edges that collectively define a bag opening, each of the primary bag sheets comprising a first fold line, a first foldable sealing section located below the first fold line, and a second foldable sealing section located between the first fold line and the top edge, each of the first foldable sealing sections being formed with at least one first carrying hole, each of the second foldable sealing sections being formed with at least one second carrying hole that is arranged symmetric with respect to the first carrying hole about the first fold line, the second foldable sealing sections of the primary bag sheets being foldable along the first fold lines toward the same direction to be overlapping and stacked on the first foldable sealing sections so that the second carrying hole and the first carrying hole correspond to and communicate with each other; and a bottom sheet connected to bottom edges of the primary bag sheets and two side bag sheets extending upward from two opposite side edges of the bottom sheet, respectively, and are each connected to side edges of the primary bag;

wherein each of the first foldable sealing sections is further formed with two extend-through retention slits respectively located at left and right sides of the first carrying hole, and each of the second foldable sealing sections is further formed with two extend-through retention tabs respectively located at left and right sides of the second carrying hole so that when the second foldable sealing sections of the primary bag sheets are folded along the first fold lines toward the same direction to be overlapping and stacked on the first foldable sealing sections, the extend-through retention tabs are set at locations each corresponding to one of the extend-through retention slits of each of the first foldable sealing sections and the extend-through retention tabs are each allowed to extend through one of the extend-through retention slits to have the first foldable sealing sections and the second foldable sealing sections securely attached to each other.

9. The carry-on package bag as claimed in claim 8, wherein each of the extend-through retention slits comprises a first slit section extending leftwards and rightwards to receive one of the extend-through retention tabs corresponding thereto to extend there through, a second slit section extending downward from a middle point between two opposite ends of the first slit section, and a third slit section extending leftwards and rightwards from an end of the second slit section that is distant from the first slit section.

10. The carry-on package bag as claimed in claim 9, wherein each of the extend-through retention slits further comprises two four slit sections extending upward from the two opposite ends of the first slit section respectively.

11. The carry-on package bag as claimed in claim 10, wherein each of the first foldable sealing sections is further formed with a first hanging hole and each of the second foldable sealing sections is further formed with a second hanging hole, so that when the primary bag sheets are folded along the first fold lines toward the same direction to be overlapping and stacked on the second foldable sealing sections, the first hanging hole and the second hanging hole correspond to and communicate with each other.

12. The carry-on package bag as claimed in claim 11, wherein each of the first foldable sealing sections is formed with three first carrying holes and each of the second foldable sealing sections is formed with three second carrying holes.

13. The carry-on package bag as claimed in claim 12, wherein the first carrying holes of each of the first foldable sealing section are spaced from each other leftward and rightward and a middle one of the first carrying holes is located further from a top edge of the primary bag sheet than left and right ones of the first carrying holes.

14. The carry-on package bag as claimed in claim 13, wherein each of the side bag sheets is formed with a vertical fold line, at least an extend-through retention slit, and at least an extend-through retention tab, each of the side bag sheets comprising a first foldable section located at one side of the vertical fold line and a second foldable section located at an opposite side of the vertical fold line, each of the side bag sheets being foldable along the vertical fold line such that the first foldable section and the second foldable section of the side bag sheet are overlapping and stacked on each other and the extend-through retention slit and the extend-through retention tab of the side bag sheet respectively corresponding to the extend-through retention slits and the extend-through retention tabs of the primary bag sheets.

15. The carry-on package bag as claimed in claim 14, wherein each of the side bag sheets is further formed with at least a side carrying hole, so that when the side bag sheets re folded along the vertical fold lines, the side carrying holes of the side bag sheets respectively correspond to the first carrying holes and the second carrying holes of the primary bag sheets.

16. The carry-on package bag as claimed in claim 8, wherein each of the second foldable sealing sections further comprises a tongue plate connected to a bottom edge of the second carrying hole so that when the second foldable sealing sections of the primary bag sheets are folded along the first fold lines toward the same direction to be overlapping and stacked on the first foldable sealing sections, the tongue plate extends from the second foldable sealing section through the first carrying hole of the first foldable sealing section.

17. A carry-on package bag, comprising:

a bag opening;

two primary bag sheets, which are opposite to each other and have top edges that collectively define a bag opening, each of the primary bag sheets comprising a first fold line, a first foldable sealing section located below the first fold line, and a second foldable sealing section located between the first fold line and the top edge, each of the first foldable sealing sections being formed with at least one first carrying hole, each of the second foldable sealing sections being formed with at least one second carrying hole that is arranged symmetric with respect to the first carrying hole about the first fold line, the second foldable sealing sections of the primary bag sheets being foldable along the first fold lines toward the same direction to be overlapping and stacked on the first foldable sealing sections so that the second carrying hole and the first carrying hole correspond to and communicate with each other; and a bottom sheet connected to bottom edges of the primary bag sheets and two side bag sheets extending upward from two opposite side edges of the bottom sheet, respectively, and are each connected to side edges of the primary bag;

wherein each of the primary bag sheets further comprises a second fold line that is located closer to the top edge of the primary bag sheet than the first fold line and a third foldable sealing section extending upward from the second fold line and located closer to the top edge of the primary bag sheet than the second foldable sealing section, the third foldable sealing section being formed with at least one third carrying hole, the third foldable sealing sections of the primary bag sheets being foldable along the second fold lines toward the same direction so as to be overlapping and stacked on the second foldable sealing sections to allow the third carrying hole to correspond to and communicate with the first carrying holes and the second carrying holes;

wherein each of the first foldable sealing sections is formed with two extend-through retention slits respectively located at left and right sides of the first carrying hole; each of the second foldable sealing sections is formed with two extend-through retention tabs respectively located at left and right sides of the second carrying hole; and each of the third foldable sealing sections being formed with two extend-through retention tabs respectively located at left and right sides of the third carrying holes so that when the primary bag sheets are folded along the first fold lines and the second fold lines toward the same direction, the extend-through retention tabs of the third foldable sealing sections and the extend-through retention tabs of the second foldable sealing sections correspond to each other to allow the extend-through retention tabs to each extend one of the extend-through retention slits of each of the first foldable sealing sections to have the first foldable sealing sections, the second foldable sealing sections, and the third foldable sealing sections securely attached to each other.

18. The carry-on package bag as claimed in claim 17, wherein each of the extend-through retention slits comprises a first slit section extending leftwards and rightwards to receive one of the extend-through retention tabs corresponding thereto to extend there through, a second slit section extending downward from a middle point between two opposite ends of the first slit section, and a third slit section extending leftwards and rightwards from an end of the second slit section that is distant from the first slit section.

19. The carry-on package bag as claimed in claim 18, wherein each of the extend-through retention slits further comprises two four slit sections extending upward from the two opposite ends of the first slit section respectively.

20. The carry-on package bag as claimed in claim 19, wherein each of the first foldable sealing sections is further formed with a first hanging hole; each of the second foldable sealing sections is further formed with a second hanging hole; each of the third foldable sealing sections is further formed with a third hanging hole, so that when the primary bag sheets are folded along the first fold lines and the second fold lines toward the same direction to have the first foldable sealing sections, the second foldable sealing sections, and the third foldable sealing sections overlapping and stacked on each other, the first hanging holes, the second hanging holes, and the third hanging holes correspond to and communicate with each other.

21. The carry-on package bag as claimed in claim 20, wherein each of the first foldable sealing sections is formed with three first carrying holes; each of the second foldable sealing sections is formed with three second carrying holes; and each of the third foldable sealing sections is formed with three third carrying holes.

22. The carry-on package bag as claimed in claim 21, wherein the first carrying holes of each of the first foldable sealing section are spaced from each other leftward and rightward and a middle one of the first carrying holes is located further from a top edge of the primary bag sheet than left and right ones of the first carrying holes.

23. The carry-on package bag as claimed in claim 22, wherein each of the side bag sheets is formed with a vertical fold line, at least an extend-through retention slit, and at least an extend-through retention tab, each of the side bag sheets comprising a first foldable section located at one side of the vertical fold line and a second foldable section located at an opposite side of the vertical fold line, each of the side bag sheets being foldable along the vertical fold line such that the first foldable section and the second foldable section of the side bag sheet are overlapping and stacked on each other and the extend-through retention slit and the extend-through retention tab of the side bag sheet respectively corresponding to the extend-through retention slits and the extend-through retention tabs of the primary bag sheets.

24. The carry-on package bag as claimed in claim 23, wherein each of the side bag sheets is further formed with at least a side carrying hole, so that when the side bag sheets re folded along the vertical fold lines, the side carrying holes of the side bag sheets respectively correspond to the first carrying holes, the second carrying holes, and the third carrying holes of the primary bag sheets.

* * * * *